US007107749B2

(12) United States Patent
Wetzels et al.

(10) Patent No.: US 7,107,749 B2
(45) Date of Patent: Sep. 19, 2006

(54) METHOD FOR SPLICING A LAID ROPE

(75) Inventors: Karel Jozef Wetzels, Kerkrade (NL); Christiaan Henri Peter Dirks, Dilsen (BE)

(73) Assignee: DSM IP Assets B.V., Heerlen (NL)

( * ) Notice: Subject to any disclaimer, the term of this patent is extended or adjusted under 35 U.S.C. 154(b) by 0 days.

(21) Appl. No.: 10/532,806

(22) PCT Filed: Oct. 31, 2003

(86) PCT No.: PCT/NL03/00756

§ 371 (c)(1),
(2), (4) Date: Jul. 19, 2005

(87) PCT Pub. No.: WO2004/039715

PCT Pub. Date: May 13, 2004

(65) Prior Publication Data

US 2006/0048494 A1 Mar. 9, 2006

(30) Foreign Application Priority Data

Nov. 1, 2002 (EP) ..... 02079571

(51) Int. Cl.
*B65H 69/06* (2006.01)

(52) U.S. Cl. ..... 57/22; 57/202

(58) Field of Classification Search ..... 57/22, 57/23, 202

See application file for complete search history.

(56) References Cited

U.S. PATENT DOCUMENTS

| | | | | |
|---|---|---|---|---|
| 2,482,204 | A * | 9/1949 | Peterson | 57/202 |
| 2,600,395 | A | 6/1952 | Domoj et al. | |
| 2,943,434 | A * | 7/1960 | Joy et al. | 57/202 |
| 3,017,739 | A * | 1/1962 | Gathman | 57/202 |
| 3,934,397 | A * | 1/1976 | Black | 57/202 |
| 4,058,049 | A * | 11/1977 | Bech | 87/8 |
| 4,191,009 | A * | 3/1980 | Thomson | 57/202 |
| 6,422,118 | B1 * | 7/2002 | Edwards | 87/13 |

OTHER PUBLICATIONS

Copy of International Search Report in PCT/NL2003/000756.

* cited by examiner

*Primary Examiner*—Shaun R. Hurley
(74) *Attorney, Agent, or Firm*—Nixon & Vanderhye PC

(57) ABSTRACT

Method to make a splice in a laid rope construction containing at least two strands includes splitting one end of the laid rope into a first part having a first number of strands and a second part having a second number of strands, then tucking the first part of the first rope from a first direction into an opening in the laid rope, and thereafter tucking the second part into the opening from an opposite direction. The first and second parts are tucked at least 3 times into additional openings being separated from one another such that the first part and the second part cross over at least once all the strands of the laid rope and leave the second rope at the last opening.

7 Claims, 4 Drawing Sheets

METHOD FOR SPLICING A LAID ROPE

This application is the U.S. national phase of international application PCT/NL2003/000756 filed 31 Oct. 2003 which designated the U.S. and claims benefit of EP 02079571.2, dated 1 Nov. 2002, the entire content of which is hereby incorporated by reference.

FIELD OF INVENTION

The invention relates to a method to make a splice in a laid rope construction containing at least two strands and to a new spliced rope construction obtainable by said method.

BACKGROUND AND SUMMARY OF THE INVENTION

Splices are used amongst others in eye splices and end-for-end splices for e.g. ropes, grommets, hawsers and round slings. Splices are also used in the production of endless ropes.

A method to make a splice in a laid rope is known from "The Splicing Handbook of Barbara Merry", ISBN 0-07-135438-7. Herein a splice is made by splitting a rope in its single strands and tucking these single strands in another part of the rope in case of an eye splice, or in another rope in cases where two ropes are to be connected with each other. In the known method typically all constituting strands are separately tucked in another rope or in another part of the same rope to make an eye.

A connection made with a known splice in a rope has a lower strength than the strength of the original rope. This means that the strength retention, hereinafter referred to as "efficiency", of the known splices, being the relative strength of the splice and the strength of the original rope, is below 100%.

The invention aims to provide a method for making a splice in a laid rope construction with at least two-strand ropes, which method results in a splice with a higher efficiency than the known splice.

This aim is achieved with a method comprising the steps of:

a) Splitting one end of a first rope end in a first and a second part comprising respectively a first and a second number of strands, the first number of strands being at most one more than the second number of strands;
b) Tucking the first part from one side into an opening in a second rope, such that the opening has a first number of strands of the second rope on one side and a second number of strands on the other side, the first and second number differing at most by one;
c) Tucking the second part from the other side into the opening in the second rope;
d) Repeating steps b) and c) at least 3, respectively at least 3+1 times, whereby the respective openings in the second rope are separated such that the first and the second part have crossed over at least all the strands of the second rope once and the first and second part leave the second rope at respective last openings.

With the method according to the invention it was surprisingly found that the efficiency is higher than the efficiency of the known splice.

Figure 1:
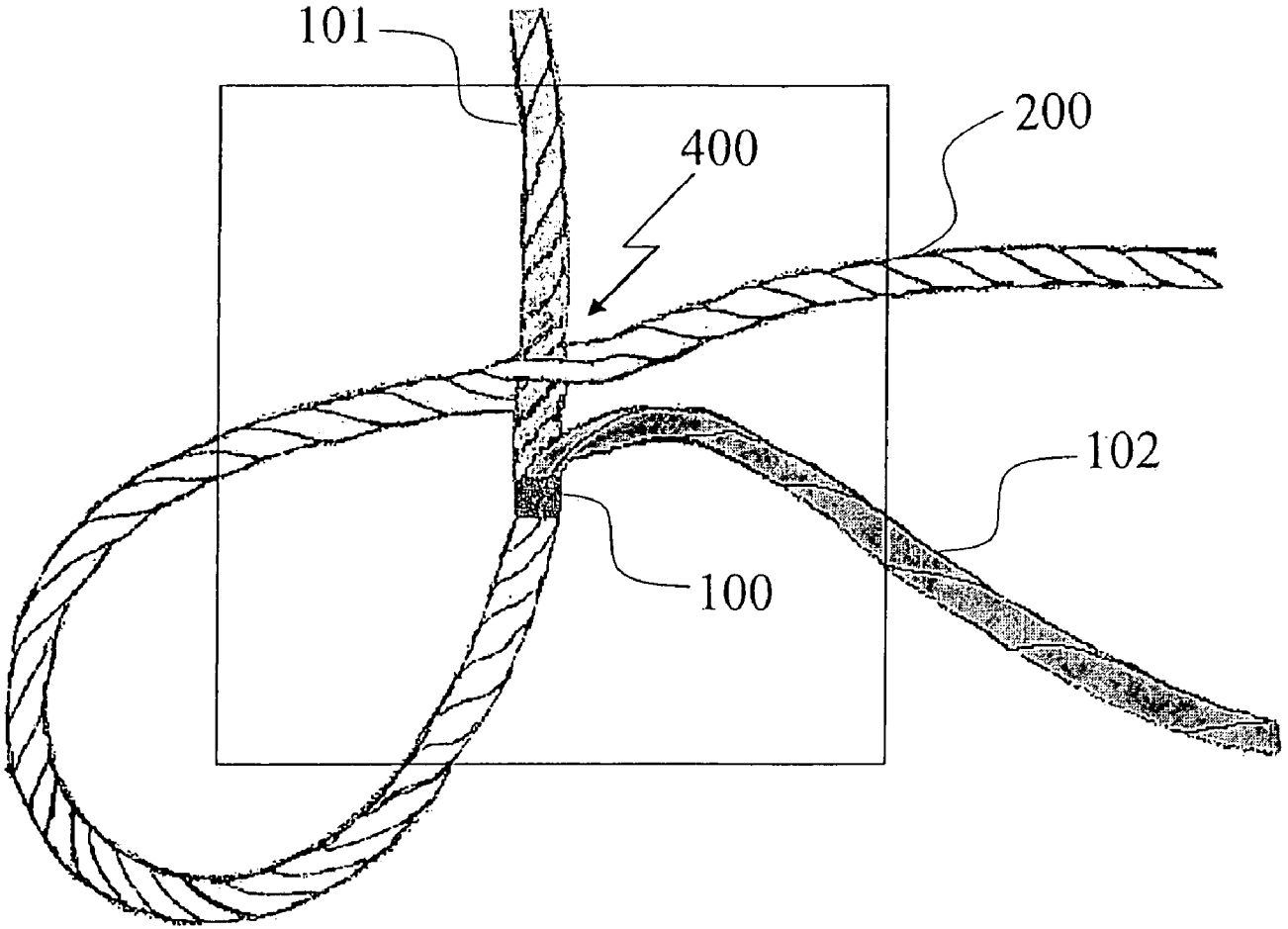
FIGS. 1–4 schematically depict a sequence of splicing a laid rope in accordance with the present invention.

The invention provides a method to make a splice in a laid rope construction with at least two strands. Ropes containing only two strands are not commonly used per se, but may form part of a larger rope construction wherein they can be connected with a splice. Preferably, the laid rope contains at least three strands, since such ropes generally are more symmetrical. In a preferred embodiment, the rope contains 3, 4 or 6 strands.

DETAILED DESCRIPTION OF THE INVENTION

In the method of the invention, as depicted schematically by FIGS. 1–4 one end (100) of a first rope (200) is split in a first part (101) and a second part (102) comprising respectively a first and second number of strands, the first part (101) having a number of strands being at most one more than the number of strands in the second part (102). This means that a 3-strand rope is split in a first part (101) with 2 strands and a second part (102) with only 1 strand. A 4-strand rope is split in two parts of 2 strands and a 6-strand rope in two parts of 3 strands.

In the method of the invention the first part (101) is tucked from one side into an opening (400) in another part of the rope (200) or a second rope (not shown), such that the opening (400) has a first number of strands of the rope (200) on one side and a second number of strands on the other side, wherein the first and second number differ at most by one. (See FIG. 1). In lieu of using another part of the rope (200) as depicted in FIGS. 1–4, the methods of the present invention may be employed using a second or other rope as such, in case two ropes are to be connected with each other. Thus, as depicted in FIGS. 1–4, using another part of the rope (200) the splice will cause an eye to be made. A second rope may also be the other end of the first rope in case a round sling or a grommet is to be made. Generally the first and the second rope have the same number of strands.

In case the first and second rope have 3 strands each, the said opening has 2 strands on one side and 1 strand on the other side. If the first and second rope has 4 or 6 strands, the said opening has 2, respectively 3 strands on both sides.

Figure 2:
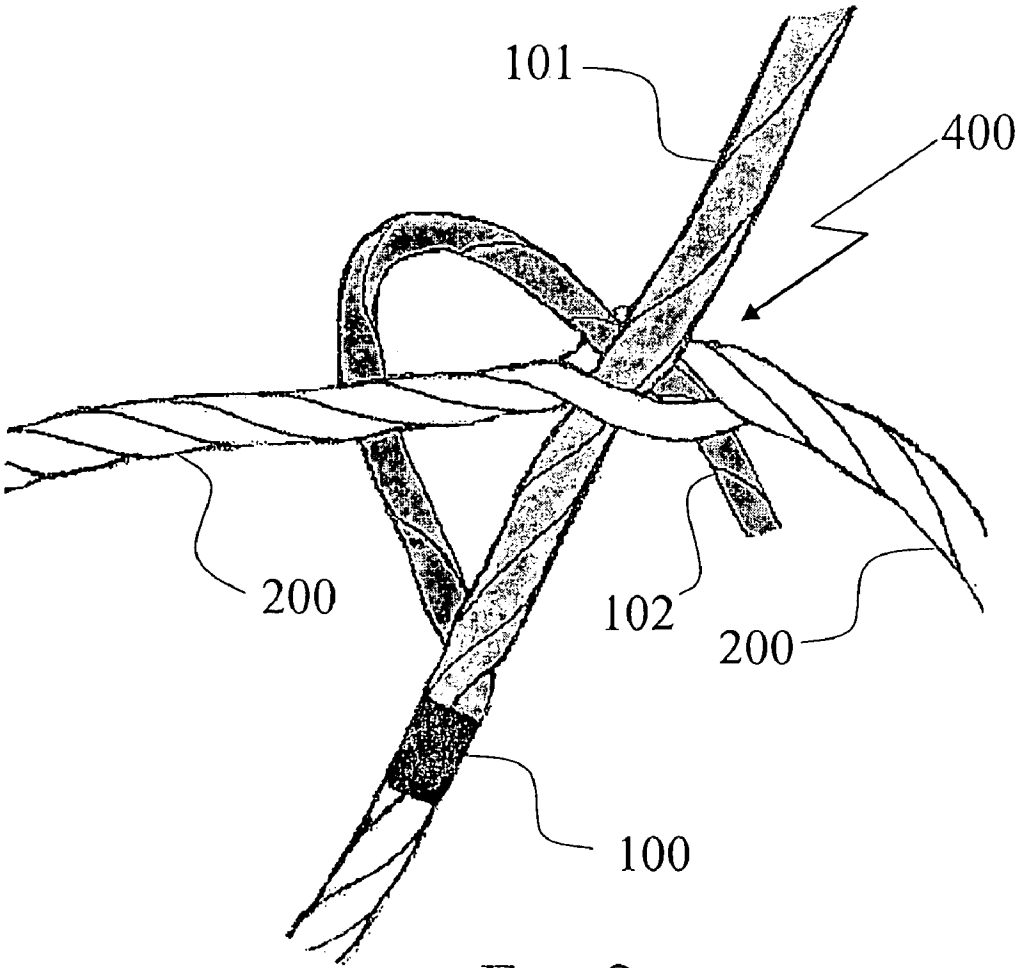

In the method of the invention as shown in FIG. 2, the second part (102) is tucked from the other side in the same opening (400) in the rope (200), which implies that both parts (101,102) of the rope (200) are tucked in different directions through the opening (400) in the rope (200).

Figure 3:
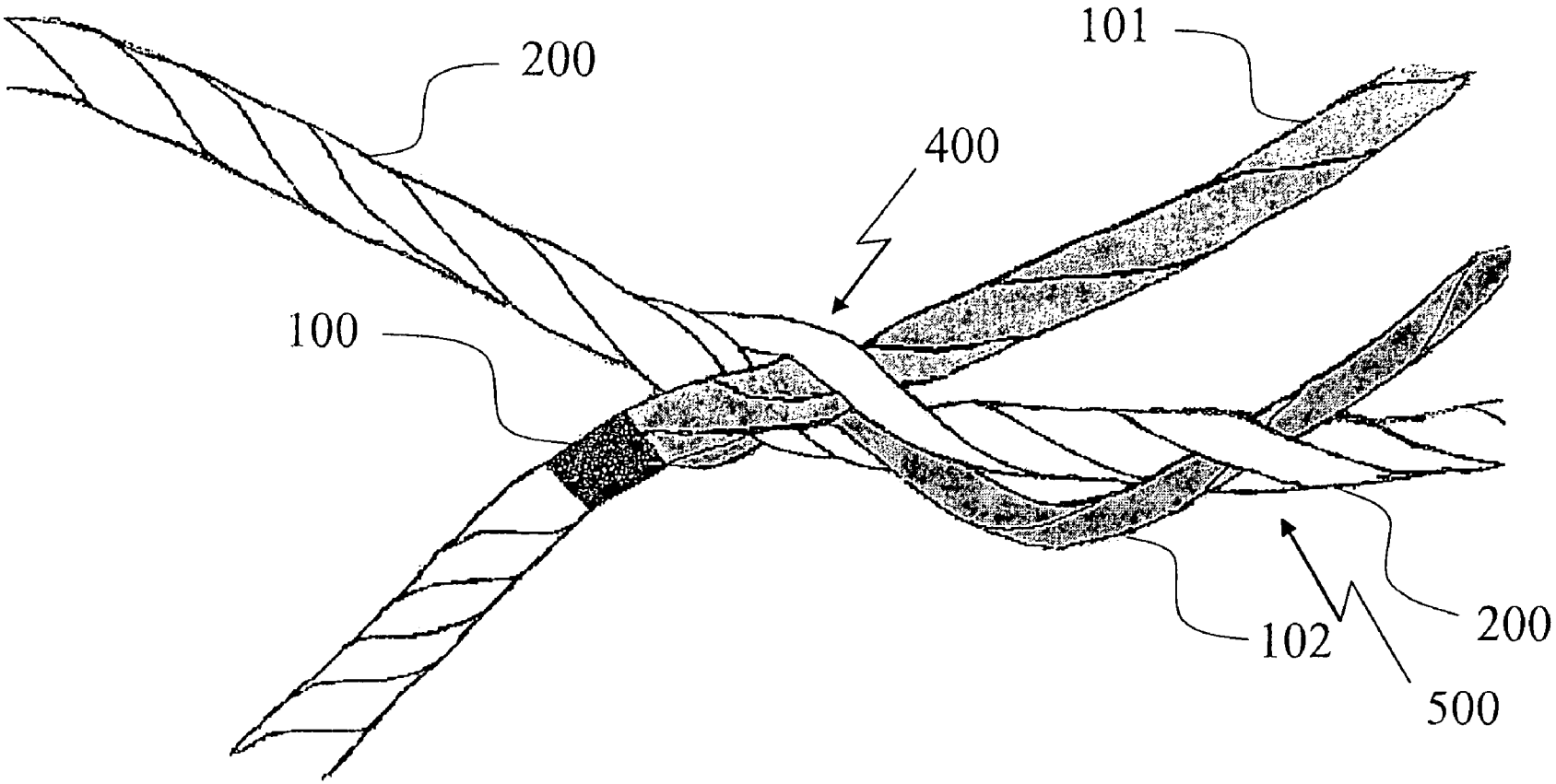
Figure 4:
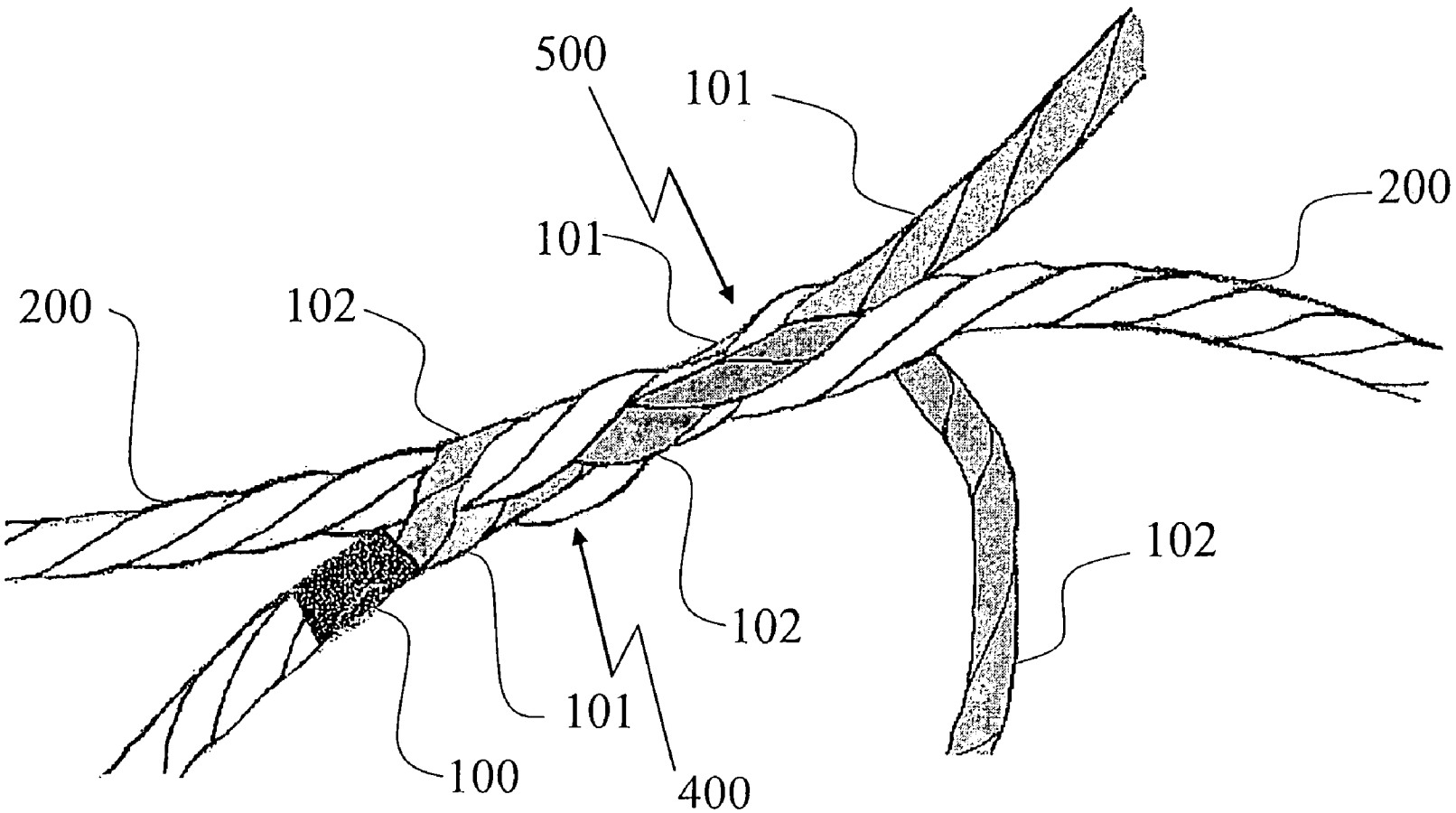

In the method of the invention as shown in FIGS. 3 and 4, steps b) and c) are repeated at least 3 times, whereby the respective openings (400) and (500) are separated such that the first part (101) and the second part (102) have crossed over at least all the strands of the rope (200) once and the first and second parts (101), (102), respectively, leave the rope (200) at respective last openings. The sequence wherein step b) and c) are repeated is of no importance for the efficiency of the resulting splice. It may be advantageous to first tuck the first part (101) several times, and than the second part (102), because this will save time.

Preferably, both parts are tensioned after every step b) and c), before continuing with the next steps, to result in a better and more compact splice construction.

After at least 3 tucks for the first, and at least 3+1 tucks for the second part, the splice can be tapered. With at least 3+1 it is meant that the second part has at least one more tuck than the first part in order to avoid the tapering of the two parts to commence at the same place.

The tapering can be done by cutting off half or one third of the first and second part of the first rope, and continue the steps b) and c) for another three or four times. This process of tapering can be repeated until the remaining first and second part are being cut off completely.

Preferably the splice is tapered by:

e) cutting off a complete strand from the first and the second part where they leave the last opening, f) repeating step b) and c) for at least 3 times g) repeating steps e) and f) until the last strand rope is being cut off.

The advantage of the method according to the invention including the tapering steps is that it is easier to determine one half or one third in a part consisting of two respectively three strand ropes than to find half of or one third of the yarns in one strand rope, especially if a splice is to be made in multi-strand rope construction.

The sequence of steps as described above for the process according to the invention is especially suited for making an eye in a rope, wherein optionally a thimble can be used around which the eye is made. If two ropes, either two ends from the same rope or from two different ropes are to be connected, the same sequence of steps is preferably repeated for the end or tail of the second rope, which end is tucked into the first rope, in order to make an optimal connection.

The rope used in the method of the invention can be made from any material commonly used for yarns, being of natural or synthetic origin. Examples of synthetic materials used in ropes with at least two strands are polyester, nylon, polypropylene, aramids, polyethylene, and high molecular weight polyethylene.

An additional advantage of the method according to the invention is, that with this method a splice is made much faster than with the known method. This advantage is particularly relevant for multi-strand ropes, and especially for ropes produced from highly drawn fibers of high molecular weight linear polyethylene. Because of the low coefficient of friction of fibres and ropes made from this material, a splice of a relatively high number of tucks is generally required to obtain a good efficiency, e.g. a splice of at least 9 tucks. By using coated high molecular weight polyethylene ropes, the number of tucks required to obtain a good efficiency can be brought down to about 7. This high number of tucks combined with advantage of the faster production of the splice according to the invention with respect to the known splice, makes that the method of the invention is preferably used in a rope comprising highly drawn fibres of high-molecular weight linear polyethylene. High molecular weight here means a weight average molecular weight (or molar mass) of at least 400,000 g/mol.

Linear polyethylene here means polyethylene having less than 1 side chain or branch per 100 C atoms, preferably less than 1 side chain per 300 C atoms, a side chain containing at least 10 C atoms. The polyethylene may also contain up to 5 mol % of one or more other alkenes that are copolymerisable therewith, such as propylene, butene, pentene, 4-methylpentene, or octene.

Preferably, use is made of polyethylene fibres consisting of polyethylene filaments prepared by a gel spinning process as described in for example GB-A-2042414, GB-A-2051667, or WO01/73173. This process essentially comprises the preparation of a solution of a polyolefin of high intrinsic viscosity, spinning the solution into filaments at a temperature above the dissolving temperature, cooling down the filaments to below the gelling temperature of the solution so that gelling occurs, and drawing the filaments before, during or after removal of the solvent.

The invention further relates to a spliced rope construction obtainable by the method of the invention, to the use of this splicing method to make an eye in a rope, as well as for end-for-end splices in ropes, grommets, hawsers, round slings, or endless ropes.

The invention further relates to a spliced rope construction according to the inventions being for example a grommet, a hawser, a round sling or an endless rope.

The invention is further elucidated by the following Examples Comparative Experiments, which are carried out with a 3-strand laid rope made of highly-drawn fibres of high-molecular weight linear polyethylene (Dyneema® SK75, ex DSM High Performance Fibers, NL), having a construction of 3×24×1/1760 dTex, 39 g/m and a lay length of 62 mm.

The ropes were coated with a Lago L45 (ex GOVI, Belgium)/water mixture (1 part by weight Lago and 2 parts by weight of water) such that after drying the rope comprises 16 mass % (relative to the weight of the rope) of the coating material.

The ropes with a length between bollards of 210 cm were subjected to a pre-stress of 4000N and a tensile test was carried out on a 100 tons Zwick tensile tester with a speed of 150 mm/min.

EXAMPLE I

An end-for-end splice was made in two ropes of the above mentioned construction with 6 tucks, tapered in 2 steps of each 3 tucks (hereinafter referred to as a 6/3/3 splice). The time to make the splice according to the invention turned out to be 2×5 minutes. The tensile strength was 76.4 kN, which is an efficiency of 100%.

EXAMPLE II

A single roundsling was made with the rope of the above-mentioned construction and a (8/3/3) splice according to the invention. The tensile strength was 2×74.8 kN, which corresponds to an efficiency of 98%

EXAMPLE III

A rope of the above-mentioned construction with two eye-splices (6/3/3) and one end-for-end splice in the middle (8/3/3) was made with splices according to the invention. The tensile strength of this construction turned out to be 74.5 kN, which corresponds with an efficiency of 97%

Comparative Experiment A

An end-for end splice was made in two ropes of the above-mentioned construction with 6 tucks, tapered in 2 steps of 3 tucks, but using a splicing method according to the state of the art, as described in "The Splicing Handbook of Barbara Merry" (ISBN 0-07-135438-7). The time to make this splice turned out to be 2×20 minutes. The tensile strength was 71.3 kN, which is a an efficiency of 93%.

Comparative Experiment B

Example II was repeated with a splice with 8 tucks, tapered in 2 steps of 3 tucks, according to the state of the art mentioned in Comparative Example A. The strength of this splice was 71.4 kN, which corresponds with an efficiency of 93%.

The invention claimed is:

1. Method to make a splice in a laid rope construction containing at least two strands comprising the steps of:

a) splitting one end of a first rope into a first part having a first number of strands and a second part having a second number of strands, the first number of strands being at most one more than the second number of strands;

b) tucking the first part of the first rope from a first direction into a first opening in a second rope which splits the second rope into first and second groupings of strands having respective numbers of strands differing by at most one strand, wherein the first grouping of strands is positioned on one side of the first part of the first rope and the second grouping of strands is positioned on another side of the first part of the first rope which is opposite to said one side;

c) tucking the second part of the first rope into the first opening in the second rope from a second direction which is opposite to the first direction from which the first part of the first rope is tucked into the first opening according to step b);

d) repeating steps b) and c) at least 3 times, the openings in the second rope being separated from one another such that the first and the second parts of the first rope cross over at least once all the strands of the second rope, wherein each of the first and second parts of the first rope leave the second rope at a last opening.

2. Method according to claim 1, wherein the laid rope construction contains at least three strands.

3. Method according to claim 1, further comprising the steps of: e) cutting a complete strand from the first and the second part where they leave the last opening; repeating steps b) and c) at least 3 times; g) repeating steps e) and f) until the last strand is cut off.

4. Spliced rope construction obtainable by the method of claim 1.

5. Spliced rope construction of claim 4, containing an eye splice, and/or an end- for-end splice.

6. Spliced rope construction of claim 4, being a grommet, a hawser, a round sling or an endless rope.

7. Spliced rope construction, wherein in step d) of claim 1, steps b) and c) are repeated at least 3 and at least 3+1 times, respectively.

* * * * *